US005765336A

United States Patent [19]

Neagle et al.

[11] Patent Number: 5,765,336

[45] Date of Patent: Jun. 16, 1998

[54] SINGLE AND DUAL LANE TRAYPACKER AND SHRINKWRAPPER

[76] Inventors: Claud Andrew Neagle, 3044 Belle Meade La., Edgewood, Ky. 41017; Steven Joseph Humbert, 7275 Woodcroft Dr., Cincinnati, Ohio 45230

[21] Appl. No.: 555,930

[22] Filed: Nov. 13, 1995

[51] Int. Cl.[6] ..... B65B 35/30

[52] U.S. Cl. ..... 53/201; 53/202; 53/48.2; 53/48.7; 53/534; 53/540; 53/543; 53/557

[58] Field of Search ..... 53/48.2, 48.7, 53/48.8, 201, 534, 540, 543, 557, 202; 198/442, 615

[56] References Cited

U.S. PATENT DOCUMENTS

| | | | |
|---|---|---|---|
| 4,036,362 | 7/1977 | Ullman | 53/48.2 X |
| 4,642,967 | 2/1987 | Culpepper | 53/201 X |
| 4,689,934 | 9/1987 | Ganz | 53/48.2 X |
| 4,702,060 | 10/1987 | Reid | 53/48.2 X |
| 5,237,795 | 8/1993 | Cheney et al. | 53/543 X |
| 5,515,668 | 5/1996 | Hunt et al. | 53/543 |
| 5,540,036 | 7/1996 | Scroggins et al. | 53/543 |
| 5,546,734 | 8/1996 | Moncrief et al. | 53/543 X |

*Primary Examiner*—Daniel Moon
*Attorney, Agent, or Firm*—R. Christian Macke

[57] ABSTRACT

A tray packing-shrink wrapping machine for packaging articles along a conveyor is disclosed. The machine is operable in a dual lane mode and a single lane mode. In both modes a collation section receives articles from an infeed section and arranges the articles into rows and columns to create batches of articles. In dual lane mode a lane divider structure separates each batch into smaller microbatches. Separate trays and sheets of heat shrinkable film are simultaneously formed around the microbatches. An in-line stacker is selectively operable in single lane or dual lane modes to stack a packed tray on top of the preceding packed tray. The machine is quickly converted to single lane mode by removing the lane divider structure and center trayforming structures, removing the center stacker elements and retracting knives in the blank feeding and film wrapping devices. A method for converting a dual lane machine to a single lane machine is also disclosed.

11 Claims, 6 Drawing Sheets

10
12
14
16
18
20
22
24
26
28
30
32
34
36
38
40
42
44
50
52
54
60
62
64
66
68
70
72
74
76
78
80

SINGLE AND DUAL LANE TRAYPACKER AND SHRINKWRAPPER

TECHNICAL FIELD

The present invention relates generally to the packaging of articles such as cans, bottles and the like to make multi-unit packages, and more specifically to the packaging of these articles by means of a tray packing and shrink wrapping apparatus. An adjustable apparatus is provided whereby articles may be selectively packaged in single or dual lane modes of operation, in stacked or unstacked configurations. A method for converting the apparatus from single to dual lane mode is also disclosed.

BACKGROUND OF THE INVENTION

Tray packing-shrink wrapping packaging machines are well known in the prior art.

The function of a single lane tray packing-shrink wrapping machine incorporating an in-line stacker is shown schematically in FIG. 1. The general sections of the machine are indicated as the infeed section 10, collation section 12, trayforming and loading section 14, stacking section 16, film wrapping section 18, and heat shrinking section 20. An unordered bulk product infeed is indicated generally at 22 and typically includes multiple vertically oriented cylindrical shaped articles 24. The articles 24 are moved along the path of travel indicated by arrows and through the various sections 10, 12, 14, 16, 18, 20 by multiple, coordinated conveyors (not shown in FIG. 1). In the collation section 12, the bulk product infeed is arranged into multiple parallel rows 26 and columns 28. For purposes of illustration only the number of rows 26 has been chosen as six (6) and the number of columns chosen as four (4). The collation section 12 generally includes a laning mechanism such as guide rails (not shown in FIG. 1) which are longitudinally oriented parallel to the path of travel for arranging the bulk infeed 22 into rows 26. The collation section also includes a laterally oriented batch separator mechanism for dividing the rows 26 into columns 28.

After formation of a process batch 30 in the collation section 12, a tray 32 is erected around the batch 30. The tray forming and loading section 14 of the machine registers a tray blank under the batch 30, then folds, glues and compresses the tray blank around the process batch 30 to form a packed tray 34. Alternating packed trays 34 are next raised in the stacking section 16 and placed on a preceding or proceeding packed tray 34 to form a two tier stack 36. Next, in the film wrapping section 18, a sheet 38 of heat shrinkable film is wrapped around the two tier stack 36. A leading edge 40 of the sheet 38 is positioned under the two tier stack 36 and, as the package proceeds through the film wrapping section 18, a wrap bar (not shown in FIG. 1) lifts the sheet 38 over and around the two-tier stack 36 such that the trailing edge 42 of the sheet 38 is tucked under the two tier stack 36 to overlap and engage the leading edge 40. The two tier stack 36 wrapped in sheet 38 then passes into the heat shrink section 20 wherein heat is applied that causes the sheet 38 to shrink to fit tightly around the two tier stack 36, resulting in a final package 44.

In some prior art packaging machines the stacking function depicted in stacking section 16 has been done off-line. Packed trays 34 are removed from the path of travel, stacked on top of one another, and re-inserted into the path of travel for further wrapping and heating. In other prior art machines, stacking is performed in-line by devices mechanically linked to the conveyor drives. Disengagement of the stacking devices, requiring tedious mechanical adjustment, is difficult and time consuming in such machines.

In the present invention the stacking section 16 may be easily selectively disengaged such that single tier packages may be processed similar to that in FIG. 1. It is understood that to adjust to single tier packages that the length of the heat shrinkable sheet 38 utilized in the film wrapping section 18 must be decreased for the smaller single tier package.

Tray packing-shrink wrapping machines similar to that shown in FIG. 1, both with and without stacking capabilities, are well known in the prior art. Such machines are particularly useful in the secondary packaging of food and beverage items which are primarily packaged in vertically oriented cylindrical containers. The packaging machine illustrated in FIG. 1 is particularly well-suited to the beverage industry wherein packages containing twenty-four (24) articles have become prevalent. Another popular package size in the beverage industry is the twelve (12) pack wherein articles are packed in a 4×3 configuration. While FIG. 1 and the above description demonstrate the tray packing-shrink wrapping of stacked or unstacked twenty-four (24) packs, it is understood that prior art machines provide for similar single lane packaging of twelve (12) packs. To avoid duplication of machinery, it has long been desired to provide a packaging machine that can produce a variety of package sizes. In the beverage industry, it is most desirable to provide a machine capable of packaging twelve (12) packs and twenty-four (24) packs and multiples thereof. However, to utilize a machine that produces twenty-four (24) packs to produce twelve (12) packs, adjustments are necessary.

Significant prior art has addressed the need to make similar packaging machines more flexible and adjustable to accommodate different size articles and different size batches. However, prior art tray packing-shrink wrapping machines that are adjustable have either required significant manual adjustments or the replacement of machine elements. For example, prior art machines have sought to provide flexibility for different size articles or batches by making the guide rails in the collation section adjustable to accommodate articles of different diameters and batches of different sizes. Similarly, in those machines the laterally oriented batch separator mechanism, which establishes the number of articles in each column and are generally separator bars mounted on endless loop chains, require tedious and time consuming adjustments for differing article diameters or batch sizes.

Another significant disadvantage exists when a single lane packaging machine with capabilities of producing twenty-four (24) packs is used to produce twelve (12) packs. The productivity of the machine will be cut in half when it is adjusted to produce twelve (12) packs because, while the number of packages produced will be constant, a function of the speed of the machine and its conveyors, the number of articles in each package is halved.

One way to increase machine productivity known in the prior art is to use dual lane packaging machines such as that shown in FIG. 2. Articles 50 are packaged in two parallel lanes to eventually form two distinct final packages 80. The product infeed section 52 and collation section 54 are similar to those in the single lane machine shown in FIG. 1. Just as the process batch 30 in FIG. 1, the process batch 60 in FIG. 2 comprises twenty-four (24) articles arranged in six (6) rows and four (4) columns.

After leaving the collation section 54, the batch 60 in the dual lane machine moves along the indicated path, engaging a center lane divider 66. The batch 60 is split into two microbatches 62, 64, each comprising (12) articles arranged in a 4×3 configuration. The microbatches 62, 64 are simultaneously processed through trayforming and loading sections 68, 70, 72, a stacking section 74, a film wrapping section 76, and a heat shrinking section 78. In a dual lane machine such as that depicted in FIG. 2, microbatches 62, 64 are processed simultaneously and conveyors moving the microbatches 62, 64 from section to section are shared, a single driving force propelling movement in both lanes. A reduction in the number and repetition of components has thus been realized by replacing two single lane machines with a single dual lane machine.

As discussed above, prior art packaging machines that are adjustable are adaptable to a wide variety of article and package sizes. Although it is highly desirable to rapidly convert from a single lane tray packing-shrink wrapping machine producing stacked or unstacked twenty-four (24) packs to a dual lane machine producing dual twelve (12) packs, no such machine is known prior to that of the present invention. A significant problem in creating such a machine has been the removal/insertion of the center divider structure, center elements necessary for the tray forming and stacking, and other centrally positioned elements located between dual lanes that must be removed for single lane operation. Because of the substantial bulk of those elements, rapid replacement/insertion has not been possible prior to the present invention.

The present invention is a tray packing, shrink wrapping machine with rapid changeover capabilities from dual lane to single lane operation and vice versa. The center divider structure, center elements necessary for the trayforming and stacking and other centrally positioned elements are quickly and easily removed/inserted to convert the machine. Other adjustments to necessary elements such as outside guide rails and stacking devices utilized in both single lane and dual lane modes, are facilitated by the apparatus of the present invention. In addition, a method for rapidly converting a dual lane tray packing-shrink wrapping machine to a single lane machine, and vice versa, is disclosed.

These and other features and advantages of the invention disclosed herein will become more apparent from the following specification and accompanying drawings.

SUMMARY OF THE INVENTION

In a preferred embodiment the present invention provides an apparatus for tray packing-shrink wrapping that is quickly and easily adapted from a single lane packaging mode to a dual lane packaging mode and vice versa.

It is another object of the present invention to provide an apparatus for dual lane tray packing-shrink wrapping that includes a removable center divider structure, removable center elements used in trayforming, and an adjustable stacker used in the dual lane apparatus to make the apparatus adaptable to use as a single lane tray packing-shrink wrapping machine.

It is a further object of the present invention to provide an apparatus for tray packing-shrink wrapping having a deselectable in-line stacker such that stacked and unstacked packages may be produced by the same apparatus.

It is yet a further object of the present invention to provide an apparatus for tray packing-shrink wrapping that is adjustable from a single lane packaging mode to a dual lane packaging mode and which includes a deselectable in-line stacker operable in either mode.

Still another object of the present invention is to provide a method for converting a dual lane tray packing-shrink wrapping apparatus to a single lane tray packing-shrink wrapping apparatus and vice versa.

Further objects and advantages of the present invention will become apparent from the following description of the drawings and the preferred embodiments.

BRIEF DESCRIPTION OF THE DRAWINGS

FIG. 4 B is a top view of the center divider structure and tray forming and loading section in dual lane operation of the present invention;

FIG. 4 C is a tray blank utilized in each lane of dual operation of the present invention;

FIG. 5 B is a top view of the tray forming and loading section in single lane operation of the present invention;

FIG. 5 C is a tray blank utilized in single operation of the present invention;

DETAILED DESCRIPTION OF THE INVENTION

Figures 1, 2:
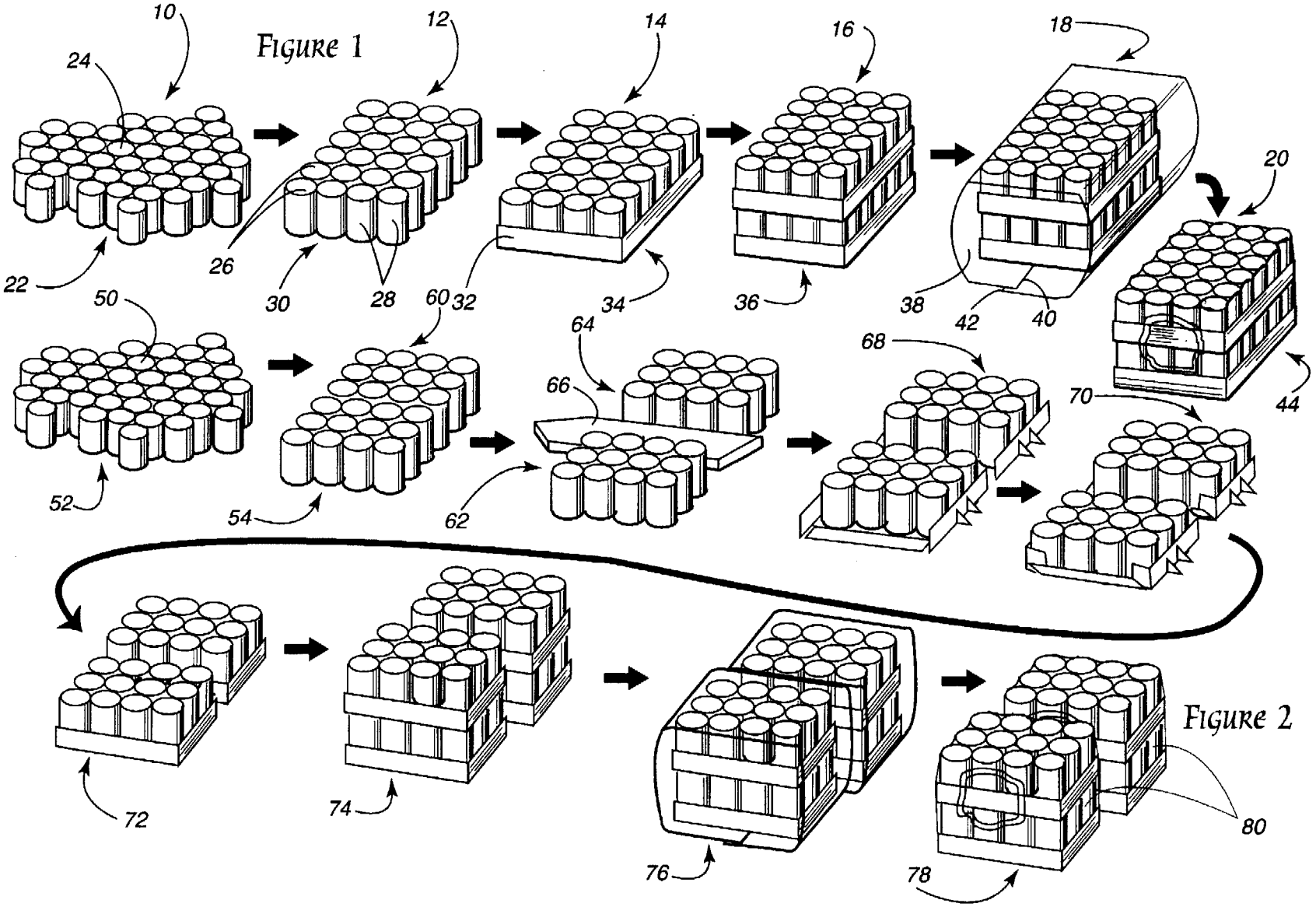
FIG. 1 is a schematic representation of a prior art single lane tray packing-shrink wrapping operation including stacking.
FIG. 2 is a schematic representation of a prior art dual lane tray packing-shrink wrapping operation having in-line stacking in each lane.

The packaging process performed by a single lane tray packing-shrink wrapping apparatus including an in-line stacking mechanism is depicted in FIG. 1. The process performed in a dual lane apparatus is disclosed in FIG. 2.

Figure 3:
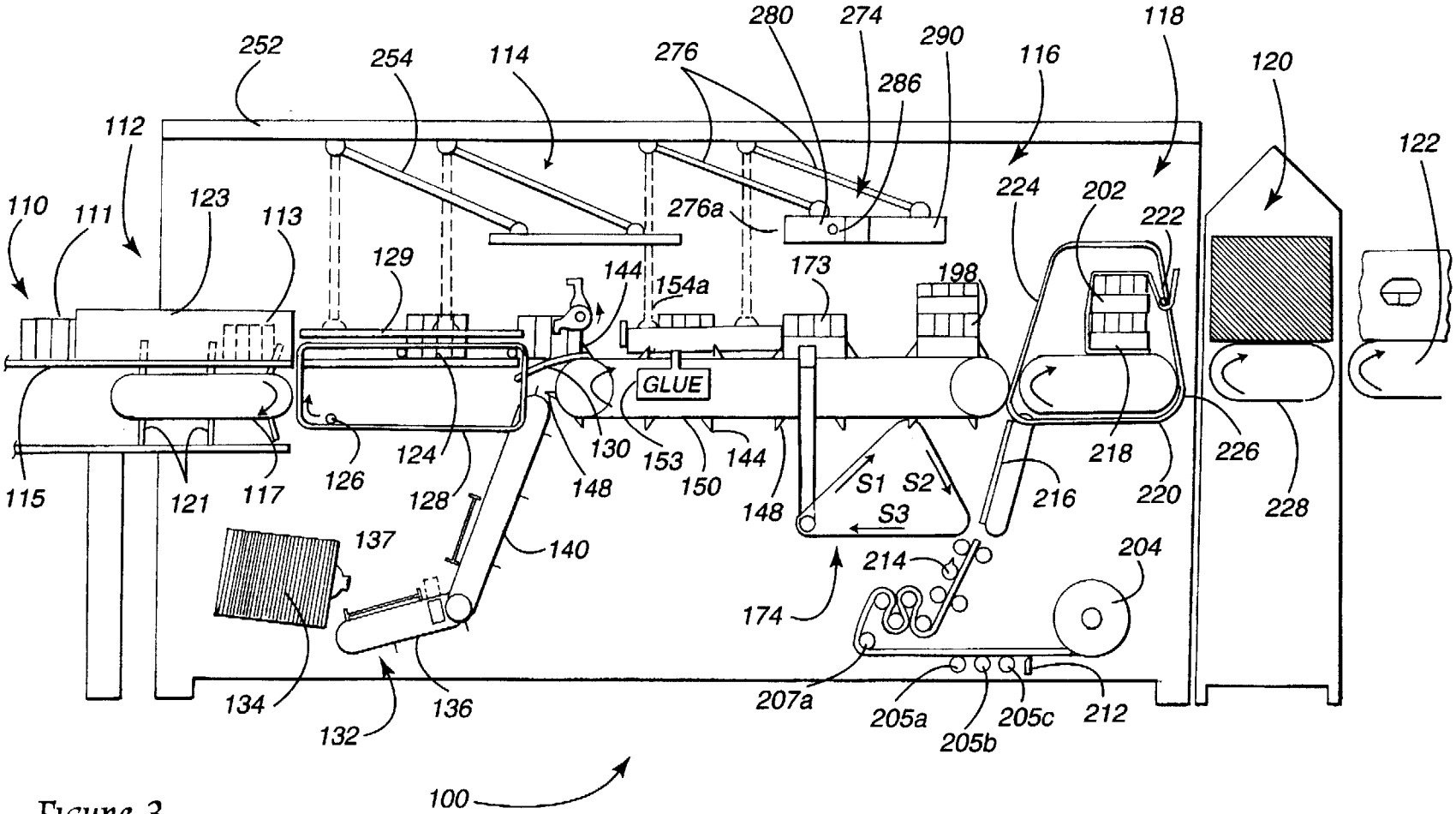
FIG. 3 is a schematic representation side view of the tray packing-shrink wrapping apparatus of the present invention set up for use in single lane mode of operation.

FIG. 3 is a side view schematic representation of the present invention, a tray packing-shrink wrapping machine 100 that is operable in a single lane mode or a dual lane mode. As depicted in FIG. 3, the machine 100 is set up to operate in single lane mode. The infeed section 110 corresponds to the infeed section 10 of FIG. 1 and infeed section 52 of FIG. 2. Vertically oriented cylindrical articles 111 such as beverage cans (see articles 24 in FIG. 1 and articles 50 in FIG. 2) are received in unordered arrangement in the infeed section 110. The articles are then collated into batches in the collation section 112. A tray is formed around and loaded with articles 111 at tray forming and loading section 114. Alternating packed trays are stacked on top of the preceding packed trays in stacking section 116. Heat shrinkable film is wrapped around each two-tier stack in film wrapping section 118, and heat is applied at heat shrink section 120 to shrink the film to fit tightly around the two-tier stack. The completed packages are then removed by an exit conveyor 122. The general function of each section 110, 112, 114, 116, 118, 120 is the same when the machine 100 is in a single lane mode of operation or a dual lane mode of operation.

The infeed section 112 organizes and separates unordered articles 111 into process batches 113. The articles 111 are received onto a dead plate 115 and are moved along by a collation conveyor 117 moving in the direction indicated. Multiple evenly spaced pusher pins 121 affixed to the conveyor 117 project up through grooves in the deck plate 115. The pusher pins 121 are spaced to receive a predetermined number of articles 111 between adjacent pusher pins 121, in the preferred embodiment the number of articles 111 being four (4). Multiple evenly spaced and vertically oriented guide rails 123 organize the articles into parallel rows. In the preferred embodiment, the number of rows is six (6). The process batch 113 generated by the infeed section 112 of the preferred is thus a twenty-four (24) article batch in a 6×4 configuration.

Upon exiting the infeed section 112, in single lane operation, the process batch 113 is moved along a dead plate 124. A flight bar 126 travels along frame 128 in the direction indicated in FIG. 3 to move the batch 113 from the infeed section 112 to the tray forming and loading section 114. The batch 113 is maintained in its 6×4 configuration as a result of pressure from the flight bar 126 and outside rails 127, 129 (see FIG. 5A).

Figure 6:
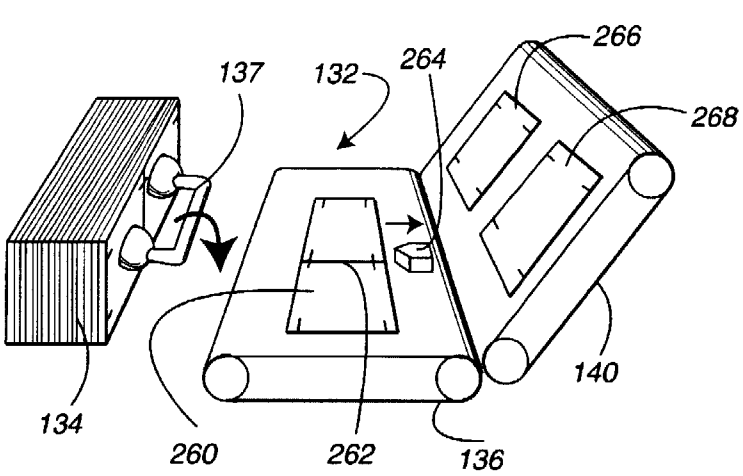
FIG. 6 is a perspective view showing the retrieval of tray blanks, separation device and conveyor means associated therewith in dual lane operation of the present invention.

The batch 113 is then married with cardboard blank 130, supplied from below by a blank feeder apparatus 132 (FIG. 6). In single lane operation the blank 130 is selected from a magazine 134 and placed onto a generally horizontal conveyor 136 by a suction handler 137. The blanks 130 is then carried upwardly by a generally vertical conveyor 140.

The blank 130 emerges up from between the end of the dead plate 124 and the trayforming section conveyor 150. In the preferred embodiment the conveyor 150 comprises four chains 150*a,b,c,d* which are driven around common sprockets 151*a,b*. It is contemplated by the principles of the present invention that more or fewer chains, or alternative conveying means, may be used in place of conveyor 150. The blank 130 utilized in single lane operation (shown in FIG. 5 C) includes a front flap 142 which engages leading edge trayforming elements 144 mounted on the tray forming section conveyor chains 150*a,b,c,d*. The marriage of the batches 113 with the blanks 130 is timed to coincide with the engagement of the blank 130 with the trayforming elements 144, resulting in the front flaps 142 being positioned and folded 90 degrees. Similarly, when the rear flap 146 emerges a trailing edge trayforming element 148 also mounted on conveyor chains 150*a,b,c,d* causes the rear flap to be folded 90 degrees. The folding of the leading and trailing flaps of the blanks corresponds to trayforming step 68 of FIG. 2.

The leading edge trayforming element 144 and trailing edge trayforming elements 148 are mounted on the trayforming section conveyor 150 and chains 150*a,b,c,d*. The conveyor 150 moves the batch 113 and blank 130, with front flap 142 and rear flap 146 folded, such that front flap side tabs 152*a,b* are bent inwardly by fixed tucking fingers 154*a,b* (see FIG. 5A). Rotary tucking fingers 155*a,b* are mounted on driven shaft 157 and are timed to rotate such that they bend the rear flap side tabs 156*a,b* inwardly. Immediately downstream from rotary tucking fingers 155*a,b* and the fixed tucking fingers 154*a,b* the side flaps 158*a,b* engage rails 160, 162 and are pre-folded through approximately (45) degrees. Pre-folding of side flaps 158*a,b* holds the bent front flap tabs 152*a,b* and rear flap tabs 156*a,b* in position. The folding of front flap tabs 152*a,b* and rear flap tabs 156*a,b* and the pre-folding of side flaps 158*a,b* corresponds to trayforming step 70 of FIG. 2.

Glue or other suitable adhesive is applied by glue applicators through openings 166*a,b* in rails 160, 162 to the bent front flap tabs 152*a,b* and bent rear flap tabs 156*a,b*. Adhesive applicators 153 (not shown in FIGS. 4A and 5A) are guns that are synchronously timed to shoot a drop of adhesive onto inwardly bent front tabs 152*a,b* and rear tabs 156*a,b*. At the point that adhesive is applied the side flaps 158*a,b* are only partially folded through approximately (45) degrees to hold the front flap tabs 152*a,b* and rear flap tabs 156*a,b* tucked in place, the side flaps 158*a,b* remaining below and not interfering with the application of adhesive onto the front tabs 152*a,b* and rear tabs 156*a,b*. Outer compression rails 168, 170 complete the folding of the side flaps 158*a,b* upwardly into face-to-face engagement with the front flap tabs 152*a,b* and rear flap tabs 156*a,b* and compress them together until the adhesive has sufficiently set up. The gluing and compression to form a packed tray 173 (FIG. 3) corresponds to trayforming step 72 of FIG. 2.

Figure 12:
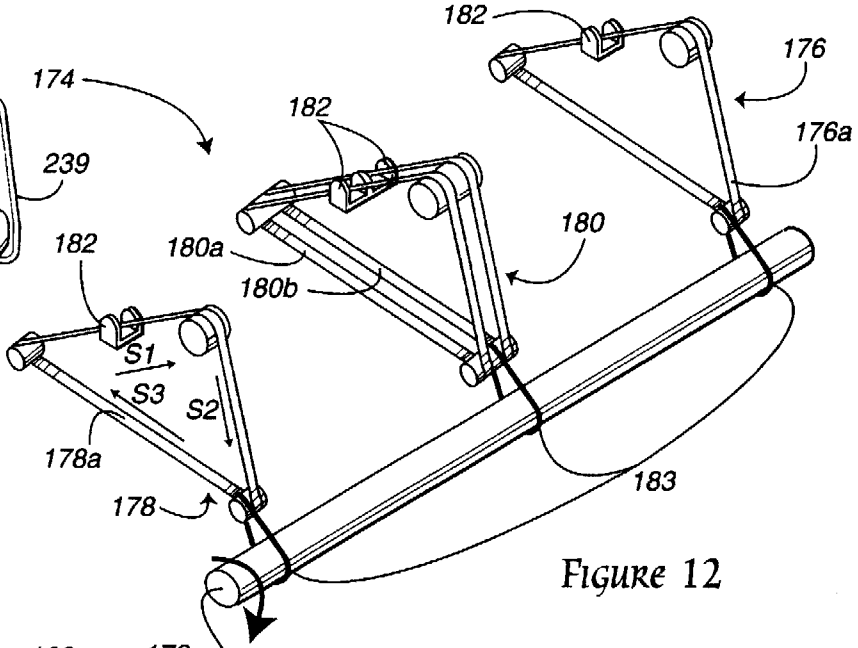
FIG. 12 is a perspective view of the stacker housings and chains.

A deselectable in-line stacker 174 is provided as part of the stacking section 116. The stacker includes two triangularly shaped outer housings 176, 178, each enclosing a single endless loop chain 176*a*, 178*a*, and a center housing 180 enclosing two chains 180*a,b* (FIG. 12). The chains in all three housings 176, 178, 180 are driven around three sprockets and rotate in the direction indicated by arrows S1, S2, and S3 in FIG. 3 and FIG. 12, all being driven by a common motive force comprising a drive shaft 181 and belts 183 so that they are synchronized.

Figure 8:
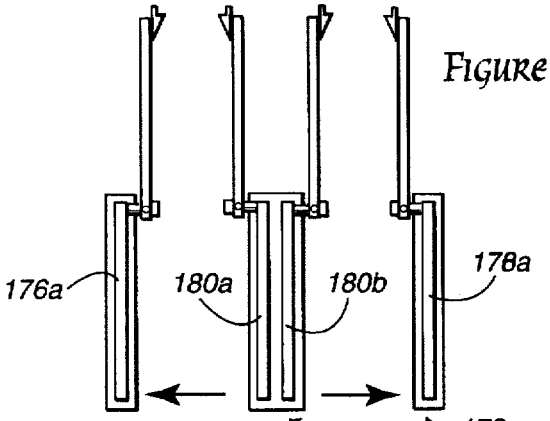
FIG. 8 is an end view of the in-line stackers in dual lane operation.
Figure 9:
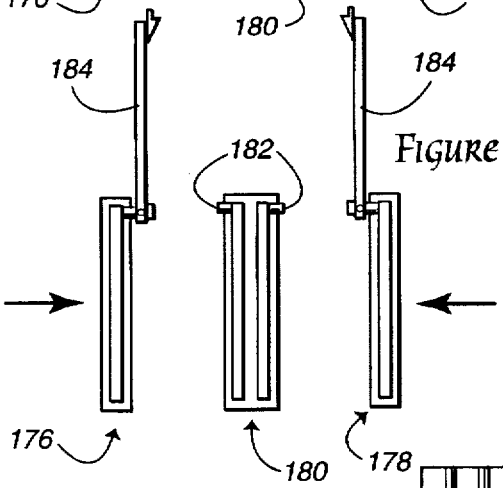
FIG. 9 is an end view of the in-line stacker in single lane operation.
Figure 10A:
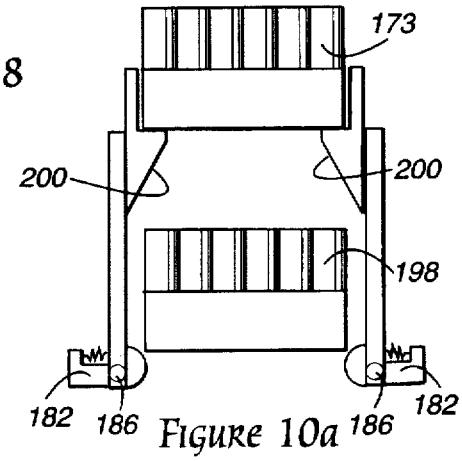
FIGS. 10A–D is a schematic representation of the operation of the in-line stacker in single lane operation of the present invention.
Figure 10B:
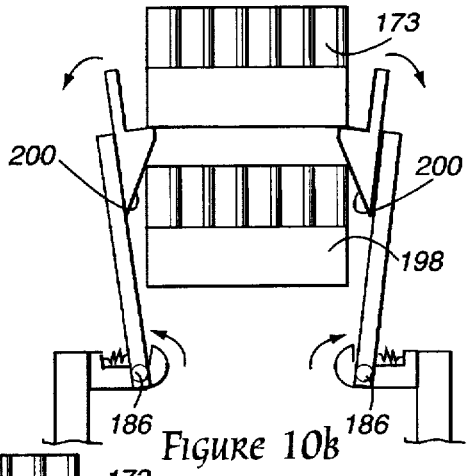
Figure 10C:
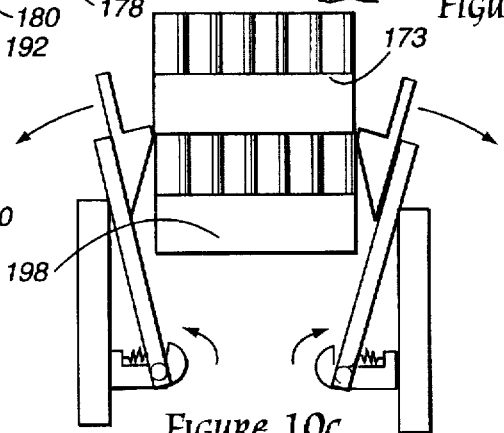
Figure 10E:
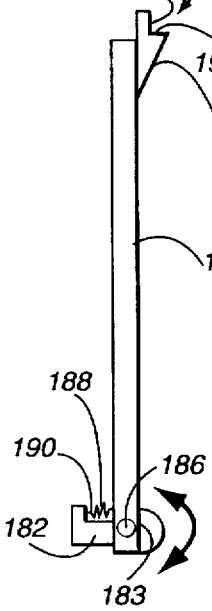
FIG. 10 E is a detailed representation of an extender bar and lifting element used in the in-line stacker(s).
Figure 10D:
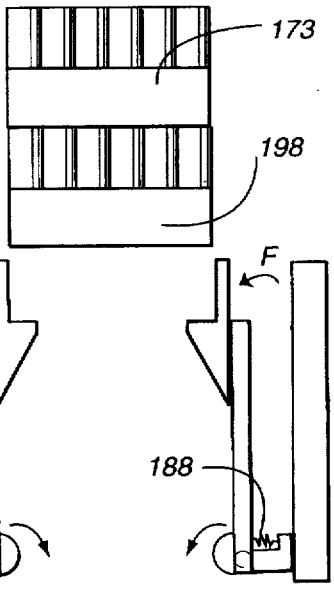

On all four stacker chains 176*a*, 178*a*, 180*a,b* there is mounted a lifter carrier 182 at the same relative location on each chain. The carrier 182 is weighted such that gravity causes it to retain the same orientation throughout the triangular path S1, S2, S3 of travel. The carriers 182 on the outside chains 176*a*, 178*a* are mounted such that they face inwardly toward the center housing 180, while the carriers 182 mounted on the center chains 180*a,b* face outwardly (see FIGS. 8 and 9). In single lane operation lifter extension arms 184 are linked only to the carriers 182 mounted on the outside chains 176*a*, 178*a* (FIG. 9). As depicted in more detail in FIG. 10E, each arm 184 is pivotally linked to its carrier 182 by a pin 186. The clockwise rotation of arm 184 about pin 186 in FIG. 10E is restricted by an upright lip 183 of carrier 182 such that it cannot go past the perpendicular orientation between the arm 184 and the carrier 182 indicated. A compression spring 188 mounted between a rear face 190 of the carrier 182 and the arm 184 causes the arm 184 and carrier 182 to maintain the generally perpendicular orientation at rest.

Lifting handlers 192 are rigidly attached to the inward side of arms 184. The handlers 192 have a horizontal face 194 and vertical face 196. As the carriers 182 traverse the triangular chain path indicated by arrows S1, S2, S3 in FIG. 3, the handlers 192 pick up the packed tray 173 and place it on top of the preceding tray 198 (shown in phantom in FIG. 3). The chains 176*a*, 178*a* are synchronously driven such that when the carrier 182 is just beginning the upward path S1, the handlers 192 engage the packed tray 173. The chains 176*a*, 178*a* are driven such that at the instant the handlers 192 engage and begin to pick up the packed tray 173, movement in direction S1 is done slowly to ensure a clean pick-up. The speed is then accelerated until just before placement onto the preceding packed tray 198, at which point movement is decelerated to allow accurate placement.

The handlers 192 further include an angled sliding surface 200. Just before the packed tray 173 is placed upon the preceding packed tray 198, the sliding surface 200 contacts the articles in the preceding tray 198 (FIG. 10B). The contact causes the arms 184 to rotate outwardly about pivot pins 186 (FIG. 10C). The arms 184 continue to rotate until the packed tray 173 is placed upon the preceding packed tray 198 (FIG. 10C). The carriers 182 continue in the downward direction S2 such that the sliding surface 200 slides down the sides of the preceding packed tray 198. Near the bottom of the downward stroke S2 the handlers 192 clear the preceding packed tray 198 and snap back into place (see directional arrows F in FIG. 10D) as a result of the bias of the spring 188. The single lane stacker 174 depicted in FIGS. 10A–D is easily deselected through detachment of arms 184 from the outside chains 176*a*, 178*a*.

After passing through the stacking section 116, and assuming operation of the stacker, a two-tier stack 202 passes into the film wrapping section 118. The film wrapping section 118 utilizes a spool 204 of heat shrinkable film (FIG. 7). The film is unwound from the spool 204 and, in single lane operation, passes over unlifted two-piece separator rollers 205*a,b,c* (shown unlifted in phantom in FIG. 7B). The film then is tensioned by being threaded around rolls 207*a,b,c,d,e*. The film is driven and tensioned between pinch rolls 208 and pinch rolls 210. A rotary cut-off knife 214 is positioned between the pinch rolls 208, 210 and is synchronously driven in the direction indicated in FIG. 7A to cut the continuous film into a sheet 216 that is sufficient to wrap the stack 202 with some overlap.

Figure 4A:
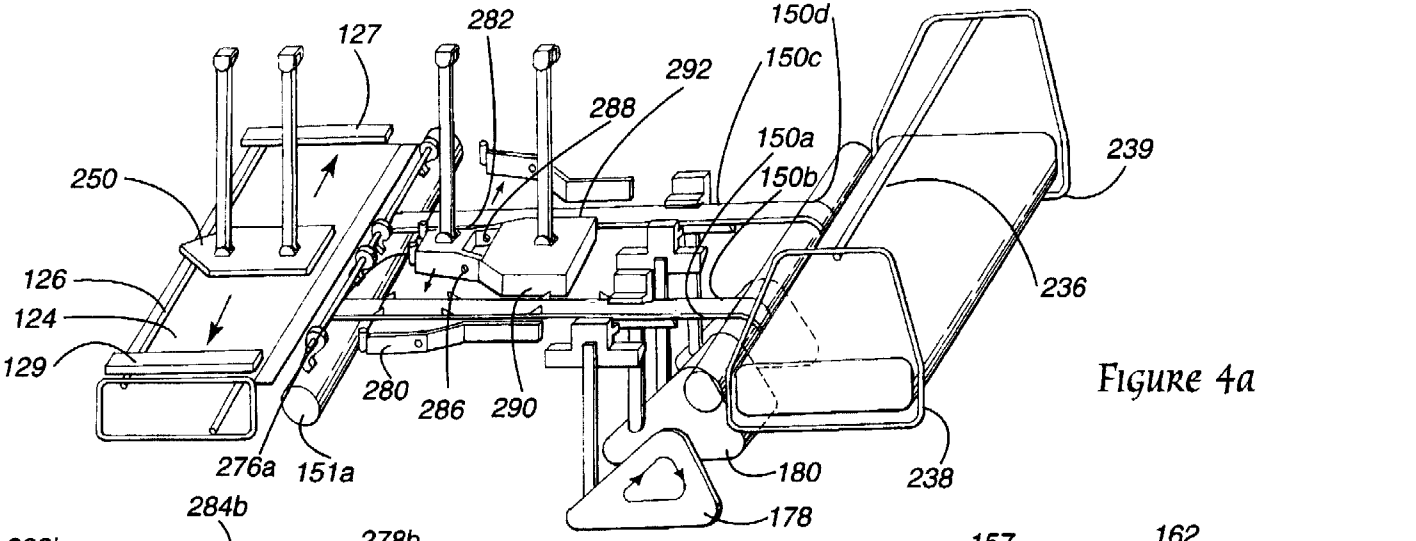
FIG. 4 A is a perspective view showing the center divider structure, tray forming and loading section and film wrapping section in dual lane operation of the present invention.
Figure 5A:
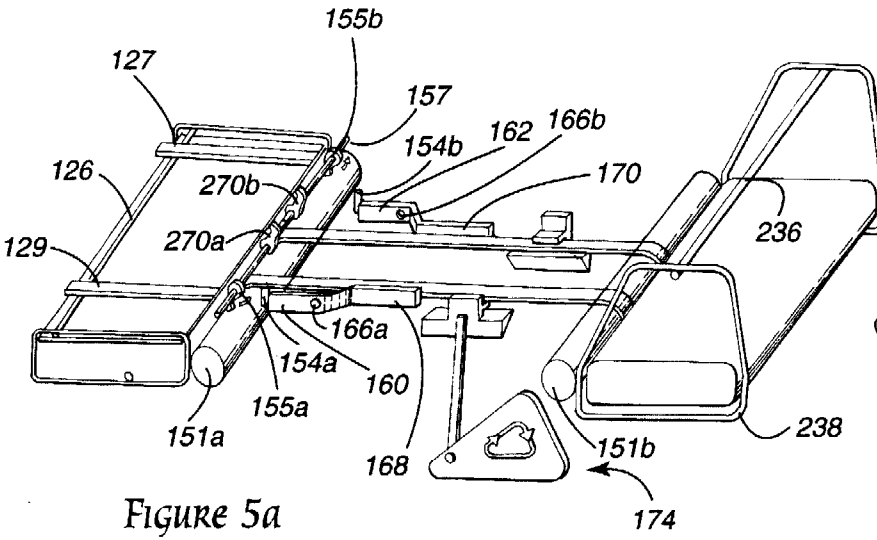
FIG. 5 A is a perspective view showing the tray forming and loading section and film wrapping section in single lane operation of the present invention.
Figure 5B:
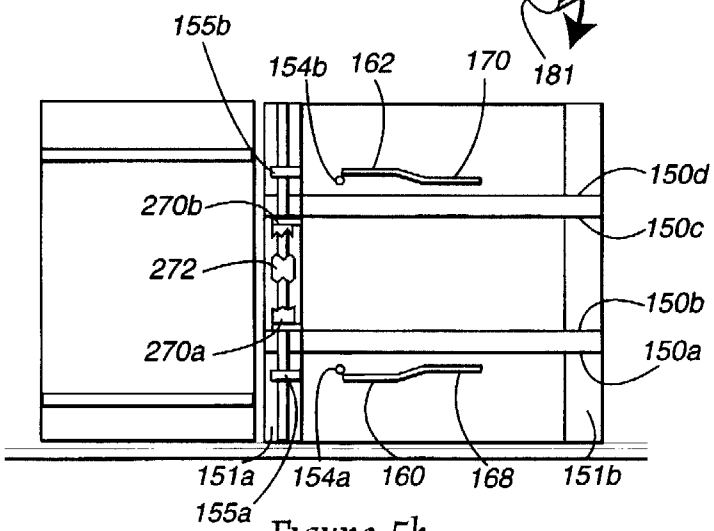
Figure 5C:
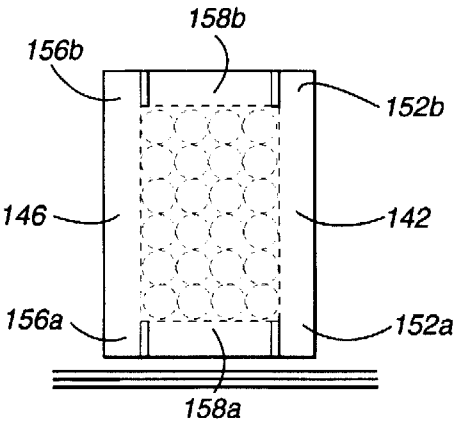
Figure 11:
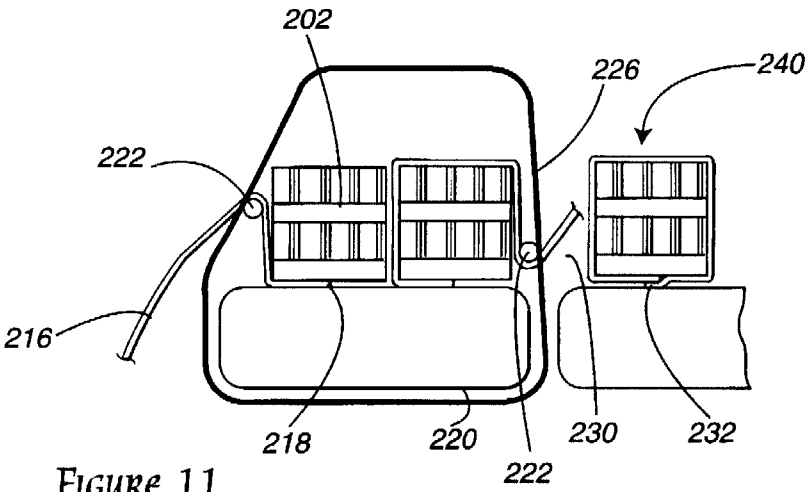
FIG. 11 is a schematic representation of the operation of the film wrapping section of the present invention.

As the stack 202 leaves the conveyor 150 the feeding of the sheet 216 is synchronized such that the leading edge 218 is pinched between the stack 202 and the wrapper conveyor 220. The wrapper conveyor 220 moves the stack 202 forward, thereby pulling the sheet 216 upwardly. When the stack 202 is fully positioned on the wrapper conveyor 220 a wrap bar 222 is synchronously driven so that it engages the sheet 216 immediately behind the stack 202. The wrap bar 222 then traverses and is accelerated around a frame 224 such that it reaches the front edge 226 of the frame 224 prior to the stack 202. The wrap bar 222 carries the sheet 216 up and over the stack 202 such that the remaining sheet 216 is hanging in front of the stack 202 as it exits the wrapping section 118. The transfer of the stack 202 from the wrapper conveyor 220 to the heat shrink conveyor 228 causes the overhang 230 to be tucked up under the stack 202 with sufficient overlap 232 to engage the leading edge 218. The preferred embodiment of the present invention includes wrap bar 236 and frames 238, 239 (FIGS. 4A and 5A). Such an arrangement is suitable for both single lane and dual lane modes of operation.

The wrapped stack 240 then passes into the heating section 120 wherein heat is applied to bond the overlap 232 onto the leading edge 218, and to shrink the film into tight engagement with the articles.

Dual lane operation of the machine 100 is similar to single lane operation, with the exception of additional elements explained herein. Insertion and removal of those additional elements has been simplified to allow quick and easy changeover from single lane to dual lane operation and vice versa.

The first modification necessary to switch from single lane to dual lane operation is to insert a lane divider structure 250 supported from an overhead beam 252 by two pivoting and locking arms 254. The lane divider structure 250 is inserted and the guide rails 127, 129 moved outwardly (FIG. 4A) so that the process batch 113, comprising a 6×4 arrangement, is split into two microbatches 256, each comprising a 3×4 arrangement. Flight bars 126 sweep the batch 113 across the dead plate 124 in the two lanes created between the outer rails 127, 129 and the center divider structure 250.

The blank feeder apparatus 132 utilized in dual lane operation is shown in FIG. 6. The magazine 134 has double wide blanks 260 having a middle seam 262. The suction handler 137 places the blank 260 onto conveyor 136 and it is moved along the direction indicated in FIG. 6 until it engages a knife separator 264 which cuts the blank 260 along the seam 262. The resulting two blanks 266, 268 (FIG. 4C) are then conveyed upward along conveyor 140.

Figure 4B:
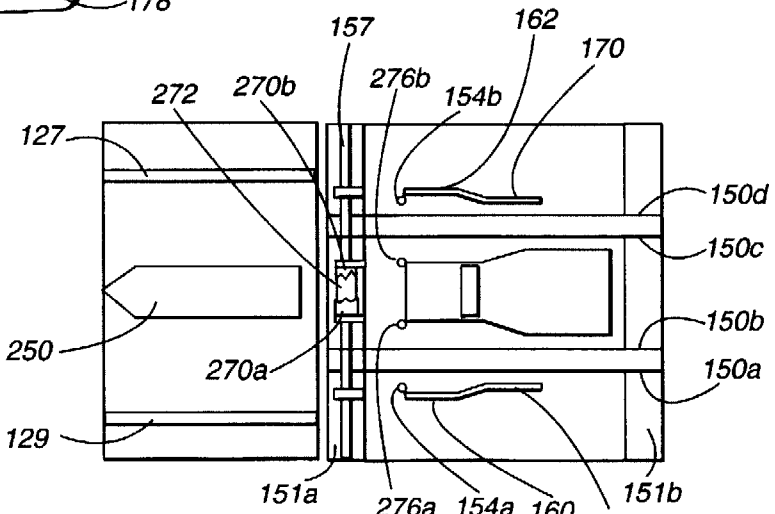
Figure 4C:
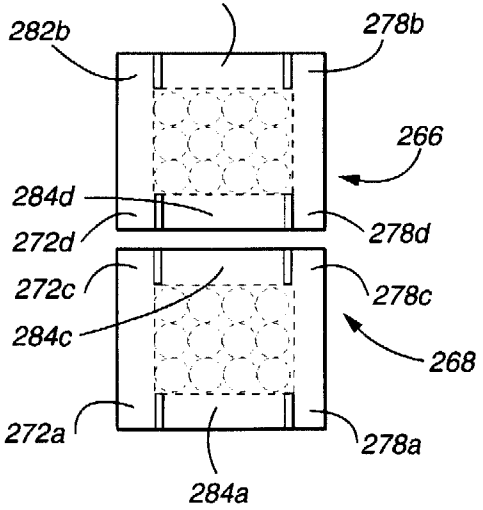

In the tray forming and loading section 114 a magnetic coil (not shown) is actuated to bring center rotary tucking fingers 270*a,b* into engagement with driven clutch shaft 272 which is fixedly mounted to driven shaft 157. The center rotary tucking fingers 270*a,b* are passed through by driven shaft 157 but are not fixed thereto. Upon activation of the magnetic coil the center tucking fingers 270*a,b* are brought into tooth to tooth engagement with the clutch shaft 272 (FIG. 4B). The center tucking fingers 270*a,b* fold the inner rear flap tabs 272*c,d* of blanks 266, 268 inwardly. The outer rear flap tabs 272*a,b* are folded by the outer rotary tucking fingers 155*a,b* which are adjusted along shaft 157 to the appropriate width.

A center tray forming structure 274 is supported from the overhead beam 252 by two pivoting and locking arms 276. The center trayforming structure 274 is inserted and the pre-folding rails 160, 162 and compression rails 168, 170 are moved outwardly (see arrows in FIG. 4A) to convert from single lane to dual lane operation. Tucking fingers 276*a,b* are provided on the structure 274 to fold the interior front flap tabs 278*c,d* of dual blanks 266, 268. The outer front flap tabs 278*a,b* are folded by outer tucking fingers 154*a,b* affixed to pre-folding rails 160, 162.

Pre-folding rails 280, 282 fold the interior side flaps 284*c,d* of blanks 266, 268. The outer side flaps 284*a,b* are folded by outer rails 160, 162 similar to the process in single lane operation. Adhesive is applied to the interior front flap tabs 278*c,d* and rear flap tabs 272*c,d* at openings 286, 288. After application of adhesive, interior compression rails 290, 292 fold the interior side flaps 284*c,d* into face to face engagement with the front flap tabs 278*c,d* and rear flap tabs 272*c,d* and compress them together until the adhesive has set up. The outer side flaps 284*a,b* are compressed by outer rails 168,170 similar lane operation.

In dual lane operation the center chains 180*a,b* of the stacker 174 are utilized. The carriers 182 affixed thereto are connected to lifter extension arms 184 that are in turn connected to handlers 192. The outer chains 176*a*, 178*a* are adjusted outwardly (see arrows in FIG. 8) so that two side by side stackers are available.

Figure 7C:
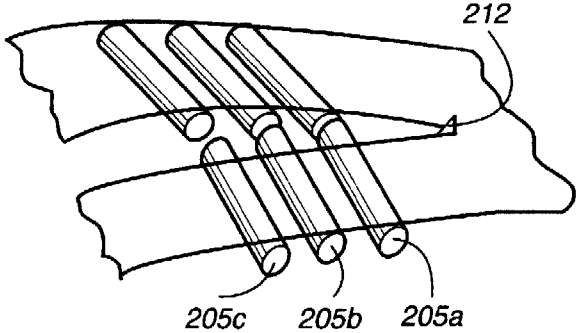
FIG. 7C is a perspective view of separator rollers tilted and separating the slit film.
Figure 7B:
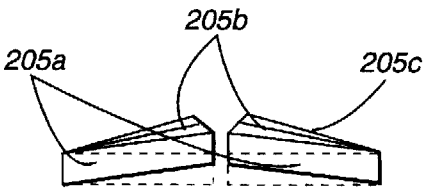
FIG. 7B is a front view of separator rollers tilted in dual lane operation.
Figure 7A:
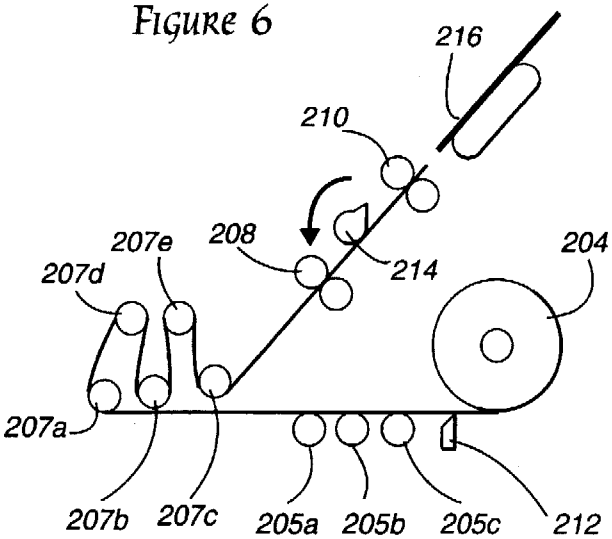
FIG. 7A is a side view of the film feeding mechanism slitting device and conveyor means associated therewith in single lane operation of the present invention.

The film wrapping section 118 in dual lane operation includes the insertion of the slitter/separator knife 212 just ahead of the two-piece separator rollers 205*a,b,c* (FIG. 7C). The slitter/separator knife 212 splits the film from spool 204 into two strips. In dual lane operation the separator rollers 205*a,b,c* are lifted at their interior ends to create a tilted film feed surface (FIG. 7B). The film, having been slit by knife 212, is thus separated along the slit as shown in FIG. 7C as a result of engaging the separator rollers 205*a,b,c*.

We claim:

1. A packaging machine for forming groups of articles along a conveyor into packages, said machine alternately operable in a single lane mode and in a dual lane mode, said machine comprising:

means for infeeding articles from a source into said machine;

means for collating said articles into process batches comprising a predetermined number of articles arranged in multiple parallel rows; and at least one lane divider structure positioned along said conveyor only in said dual lane mode to engage and subdivide each said process batch into two microbatches, said lane divider structure being removed in said single lane mode such that each said process batch remains undivided in said single lane mode.

2. The packaging machine of claim 1 wherein:

said at least one lane divider structure comprises one lane divider structure.

3. The packaging machine of claim 1 further including:

means for stacking alternating said process batches in said single lane mode, said stacking means being in-line and adjustable to provide means for stacking alternating said microbatches in said dual lane mode.

4. The packaging machine of claim 1 wherein said collating means further comprises:

laning means arranging said articles into a predetermined number of rows; and means for separating a number of said articles arranged in said rows.

5. The packaging machine of claim 4 further including:

means for forming trays for each said process batch in said single lane mode;

means for converting said tray forming means for each said process batch into a means for forming trays for each said microbatch in said dual lane mode;

means for loading each said batch into a tray to form a single packed tray in said single lane mode;

means for converting said loading means for each said process batch into a means for loading each said microbatch into trays to form dual packed trays in said dual lane mode;

means for wrapping a separate sheet of heat shrinkable film around each said process batch in said single lane mode;

means for converting said wrapping means for each said process batch into a means for wrapping a separate sheet of heat shrinkable film around each said microbatch in said dual lane mode; and means for heating each said sheet of heat shrinkable film around said process batches in said single lane mode and around said microbatches in said dual lane mode.

6. The packaging machine of claim 5 wherein said wrapping means in said single lane mode and said dual lane mode comprises:

a single film supply source;

a single cut-off means; and a slitter and separator means comprising a film slitter knife inserted only in said dual lane mode to split said film into two strips, said slitter knife being retracted in said single lane mode.

7. The packaging machine of claim 5 further comprising:

means for stacking alternating said packed trays in said single lane mode, said stacking means being in-line and adjustable to provide means for stacking alternating said dual packed trays in said dual lane mode.

8. The packaging machine of claim 5 wherein said tray forming means in said single lane mode and said dual lane mode comprises:

a single magazine of tray blanks;

a knife separator device inserted in said dual lane mode to cut said tray blanks into two tray blanks, said knife separator device being removed in said single lane mode.

9. The packaging machine of claim 8 wherein said tray forming means comprises:

means for pre-folding a blank;

means for applying adhesive to said blank; and means for compressing said blank.

10. The packaging machine of claim 5 wherein:

said at least one lane divider structure comprises one lane divider structure.

11. The packaging machine of claim 10 wherein:

said predetermined number of rows is six;

said separating means comprise hold back pins that periodically and simultaneously release four articles in each of said six rows.

* * * * *

US005765336C1

(12) EX PARTE REEXAMINATION CERTIFICATE (6246th)

United States Patent
Neagle et al.

(10) Number: US 5,765,336 C1
(45) Certificate Issued: Jun. 10, 2008

(54) SINGLE AND DUAL LANE TRAYPACKER AND SHRINKWRAPPER

(75) Inventors: Claud Andrew Neagle, Edgewood, KY (US); Steven Joseph Humbert, Cincinnati, OH (US)

(73) Assignee: Kisters, Inc., Erlanger, KY (US)

Reexamination Request:
No. 90/007,979, Mar. 22, 2006

Reexamination Certificate for:

| | |
|---|---|
| Patent No.: | **5,765,336** |
| Issued: | **Jun. 16, 1998** |
| Appl. No.: | **08/555,930** |
| Filed: | **Nov. 13, 1995** |

(51) Int. Cl.
*B65B 35/30* (2006.01)

(52) U.S. Cl. ..... 53/201; 53/48.2; 53/48.7; 53/202; 53/534; 53/540; 53/543; 53/557

(58) Field of Classification Search ..... 53/48.2, 53/48.7, 201, 202, 540, 543, 557
See application file for complete search history.

(56) References Cited

U.S. PATENT DOCUMENTS

| | | | |
|---|---|---|---|
| 4,450,949 | A | 5/1984 | Buschor et al. |
| 4,642,967 | A | 2/1987 | Culpepper |
| 4,689,934 | A | 9/1987 | Ganz |
| 5,092,448 | A | 3/1992 | Cinotti |
| 5,237,795 | A | 8/1993 | Cheney et al. |
| 5,515,668 | A | 5/1996 | Hunt et al. |
| 5,546,734 | A | 8/1996 | Moncrief et al. |

FOREIGN PATENT DOCUMENTS

| | | |
|---|---|---|
| DE | 24 08 158 | 8/1975 |
| DE | 42 07 725 A1 | 9/1983 |

OTHER PUBLICATIONS

"The Kisters Ultra–High Speed Multipackers Types 99/100 and 99/100 Z The Latest in High Speed Multipacking," pre–Jul. 1, 1993.

*Primary Examiner*—Jimmy G. Foster

(57) ABSTRACT

A tray packing-shrink wrapping machine for packaging articles along a conveyor is disclosed. The machine is operable in a dual lane mode and a single lane mode. In both modes a collation section receives articles from an infeed section and arranges the articles into rows and columns to create batches of articles. In dual lane mode a lane divider structure separates each batch into smaller microbatches. Separate trays and sheets of heat shrinkable film are simultaneously formed around the microbatches. An in-line stacker is selectively operable in single lane or dual lane modes to stack a packed tray on top of the preceding packed tray. The machine is quickly converted to single lane mode by removing the lane divider structure and center trayforming structures, removing the center stacker elements and retracting knives in the blank feeding and film wrapping devices. A method for converting a dual lane machine to a single lane machine is also disclosed.

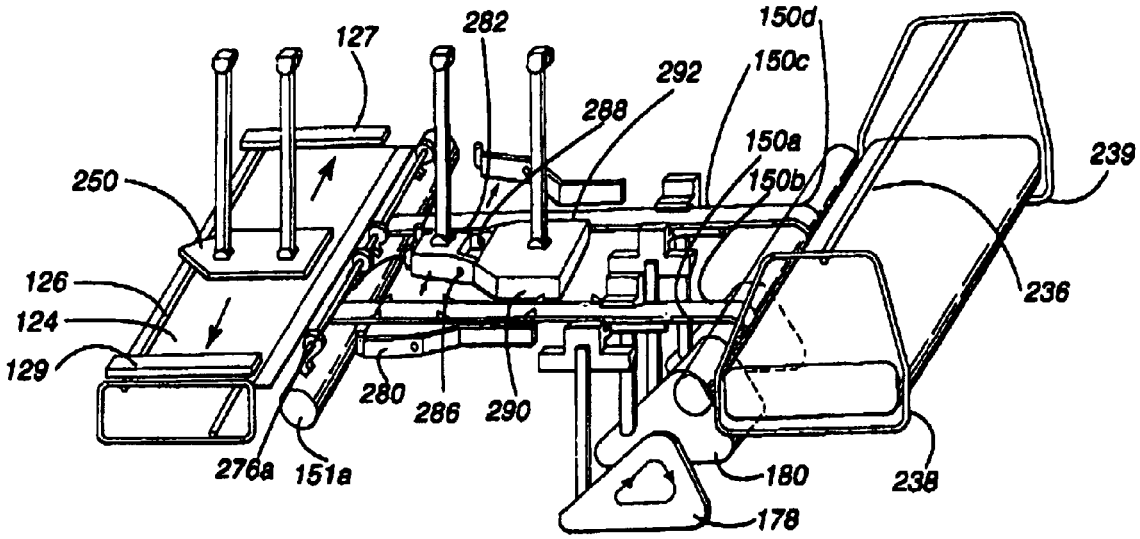

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

The patentability of claims 5–11 is confirmed.

Claims 1–4 are cancelled.

* * * * *